US009283663B2

(12) United States Patent
Hsieh

(10) Patent No.: US 9,283,663 B2
(45) Date of Patent: Mar. 15, 2016

(54) ELECTRONIC TORQUE TOOL HAVING DISCONTINUOUS TORQUE WARNING VALUES WITH AN INTERVAL THEREBETWEEN

(71) Applicant: KABO TOOL COMPANY, Taichung (TW)

(72) Inventor: Chih-Ching Hsieh, Taichung (TW)

(73) Assignee: KABO TOOL COMPANY, Taichung (TW)

( * ) Notice: Subject to any disclaimer, the term of this patent is extended or adjusted under 35 U.S.C. 154(b) by 573 days.

(21) Appl. No.: 13/726,286

(22) Filed: Dec. 24, 2012

(65) Prior Publication Data

US 2014/0174773 A1 Jun. 26, 2014

(51) Int. Cl.
*B25B 23/142* (2006.01)
*B25B 23/14* (2006.01)

(52) U.S. Cl.
CPC ..... *B25B 23/1425* (2013.01); *B25B 23/1422* (2013.01); *B25B 23/14* (2013.01)

(58) Field of Classification Search
CPC .... B25B 23/14; B25B 23/141; B25B 23/142; B25B 23/1422; B25B 23/1425; B25B 23/144; B25B 19/00; B25B 21/004; B25B 13/46; G01L 1/16; G01L 1/22; G01L 1/225; G01L 5/24; G01L 19/0007; G01L 19/0092; G01D 1/00
USPC ..... 81/60, 467, 469, 479, 481, 483; 173/20, 173/176, 181, 2, 217, 171; 73/862.21, 73/862.23
See application file for complete search history.

(56) References Cited

U.S. PATENT DOCUMENTS

| | | | | |
|---|---|---|---|---|
| 4,397,196 | A * | 8/1983 | Lemelson | 73/862.23 |
| 4,643,030 | A * | 2/1987 | Becker et al. | 73/862.23 |
| 5,315,501 | A * | 5/1994 | Whitehouse | 700/32 |
| 6,167,788 | B1 * | 1/2001 | Schonberger et al. | 81/467 |
| 6,463,811 | B1 * | 10/2002 | Putney | 73/862.21 |
| 6,968,759 | B2 * | 11/2005 | Becker et al. | 81/479 |
| 7,000,508 | B2 * | 2/2006 | Li et al. | 81/479 |
| 7,083,834 | B2 * | 8/2006 | Kuntz et al. | 428/1.1 |
| 7,331,246 | B2 * | 2/2008 | Escoe et al. | 73/862.21 |
| 7,370,539 | B2 * | 5/2008 | Gharib et al. | 73/862.21 |
| 7,493,830 | B2 * | 2/2009 | Escoe et al. | 73/862.21 |
| 7,562,589 | B2 * | 7/2009 | Anjanappa et al. | 73/862.23 |
| 7,565,844 | B2 * | 7/2009 | Crass et al. | 73/862.21 |
| 8,065,806 | B2 * | 11/2011 | Rainone et al. | 33/1 PT |
| 8,171,828 | B2 * | 5/2012 | Duvan et al. | 81/479 |
| 8,844,381 | B2 * | 9/2014 | Gharib | 73/862.21 |

* cited by examiner

*Primary Examiner* — Scott A. Smith
(74) *Attorney, Agent, or Firm* — Guice Patents PLLC

(57) ABSTRACT

An electronic torque tool includes a main body; at least one display unit disposed on the main body for displaying torque values, and several pushbuttons disposed on the main body for a user to set values to the torque tool. The electronic torque tool has resettable torque warning values, which are discontinuous values with an interval therebetween. Thanks to the interval between the discontinuous resettable torque warning values, the torque warning value of the torque tool is lower than the required tightening force. In this case, it can be avoided that a threaded member is over-tightened.

19 Claims, 4 Drawing Sheets

ELECTRONIC TORQUE TOOL HAVING DISCONTINUOUS TORQUE WARNING VALUES WITH AN INTERVAL THEREBETWEEN

BACKGROUND OF THE INVENTION

1. Field of the Invention

The present invention relates generally to an electronic torque tool, and more particularly to an electronic torque tool having discontinuous resettable torque warning values with an interval therebetween.

2. Description of the Related Art

An electronic torque tool such as an electronic torque wrench includes an electronic display screen and several pushbuttons. The display screen serves to show to a user the magnitude of the applied force (torque) in operation of the wrench. The electronic torque wrench also has a torque warning value. When the applied force of the wrench reaches the torque warning value, a warning effect is provided to remind the user to stop applying the force.

The user can adjust the torque warning value. In a torque setting mode, by means of the pushbuttons of the torque tool, the warning value can be increased or decreased and reset in accordance with the required tightening extent of different threaded structures.

When adjusting the torque warning value of the existent electronic hand tool, the torque warning value is continuously increased or decreased. For example, in the case that the current torque warning value of the torque wrench is 26 N/m, while the tightening requirement of the next threaded member is 34 N/m, then a user can press the pushbutton of the wrench to change the warning value. At this time, the warning value will continuously skip over 26, 27, 28 . . . 33 until the value of 34 is shown. After the torque warning value of 34 N/mis reset, when the applied force of the wrench reaches 34 N/m, the wrench will give a warning to the user.

Within the set range of the warning value, the warning value can be set any value. For example, the set warning value of the wrench can range from 11~50 N/m. That is, any warning value within the range of 11~50 N/m can be set to the wrench. In general, the torque warning value is set the required torque value of the threaded member to be tightened. With the above case taken as an example, the warning value is set 34 N/m, whereby when the applied force of the wrench reaches 34 N/m, the user will receive the warning.

However, due to operation inertia, when the user hears or feels the warning effect, the user can hardly immediately stop wrenching a work piece. Instead, the user will further wrench the work piece for a short period of time before stopping. In this case, the threaded member may be actually over-tightened by a tightening force of 36 N/m rather than the necessary 34 N/m.

Moreover, in operation, the user often needs to notice the warning signal so as to avoid over-tightening. This will prolong the operation time and affect the smoothness of the operation.

SUMMARY OF THE INVENTION

It is therefore a primary object of the present invention to provide an electronic torque tool, which can be set with torque warning values. The torque warning values are discontinuous resettable torque warning values with an interval therebetween.

To achieve the above and other objects, the electronic torque tool of the present invention includes a main body; at least one display unit disposed on the main body for displaying various parameters or torque values of the torque tool, and several pushbuttons disposed on the main body for a user to set the torque warning values to the torque tool.

The electronic torque tool has resettable torque warning values, which are discontinuous values with an interval therebetween. Thanks to the interval between the discontinuous resettable torque warning values, the torque warning value of the torque tool is always lower than the required tightening force of a threaded member when setting the torque warning value. Accordingly, it can be avoided that the threaded member is over-tightened.

The present invention can be best understood through the following description and accompanying drawings, wherein:

DETAILED DESCRIPTION OF THE PREFERRED EMBODIMENTS

The electronic torque tool of the present invention can be a torque wrench, a torque connection rod or a torque transmission tool. In this embodiment, the electronic torque tool is an electronic torque wrench for illustration purposes.

Figure 1:
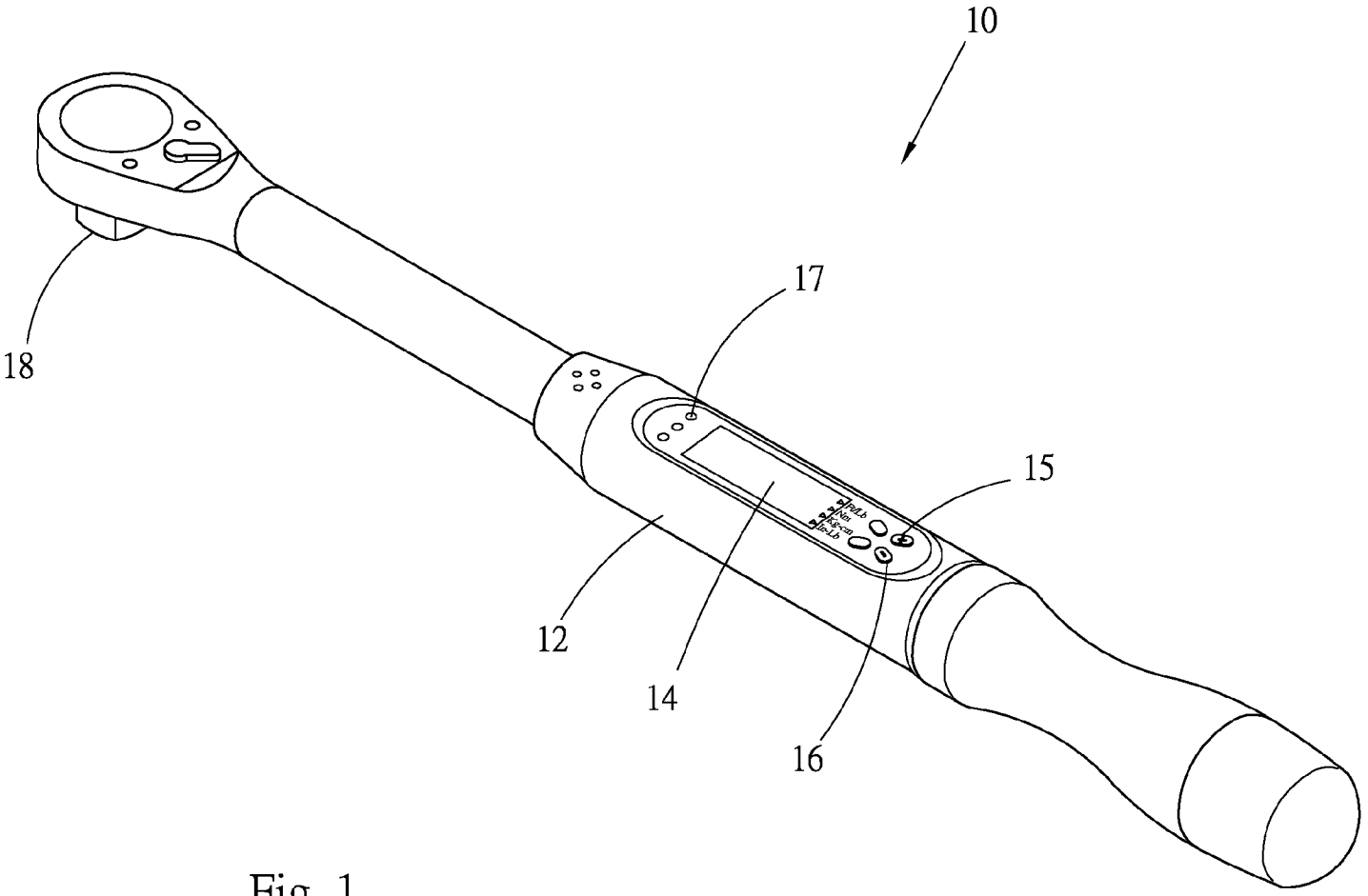
FIG. 1 is a perspective view of a first embodiment of the present invention.

Please refer to FIG. 1. According to the first embodiment, the electronic torque wrench 10 includes a main body 12, which is an elongated rod body, at least one display unit 14, several pushbuttons (representatively denoted by reference numerals 15, 16), several warning lights 17 and a sound warning unit such as a buzzer (not shown). These components are disposed on the main body 12. One end of the main body 12 is a drive end provided with a drive head 18. The drive head 18 can be a polygonal socket for fitting onto a threaded member (bolt or nut). Alternatively, the drive head can have an insertion post for plug-in connecting with a socket. Various electronic data and values of the torque tool are shown on the display unit.

An operation unit and a detection unit (not shown) are disposed in the main body 12. The operation unit (such as a microprocessor) is disposed in a circuit structure of the wrench for executing various electronic signal operations. The detection unit can be a strainmeter or a Wheatstone bridge. When using the wrench 10 to wrench a threaded member (bolt or nut), the detection unit detects the applied force of the wrench and transmits the detection signal (or detection value) to the operation unit. The operation unit converts the detection signal into a torque value, which is shown on the display unit 14 for an operator to read the actual value of the applied force in operation. The wrench has a resettable torque warning value. When the wrenching force of the wrench exceeds the set torque warning value, the warning lights 17 will emit light and/or the sound warning unit will emit a sound as an over-tightening warning signal for the operator.

The pushbuttons 15, 16 include a power pushbutton and several function pushbuttons for executing many functions, for example, but not limited to, on/off, numeral inputting, selection, setting, storage, etc. Also, by means of some function pushbuttons, the display screen can be switched between different use interfaces including torque display interface and torque setting interface and switched between metric system and British system. In the warning value setting mode, the pushbutton 15 is an increase pushbutton for increasing the value, while the pushbutton 16 is a decrease pushbutton for decreasing the value.

The setting intervals of the torque warning value of the torque tool of the present invention are discontinuous levels. That is, the torque warning values for a user to set are discontinuous values.

Figure 2:
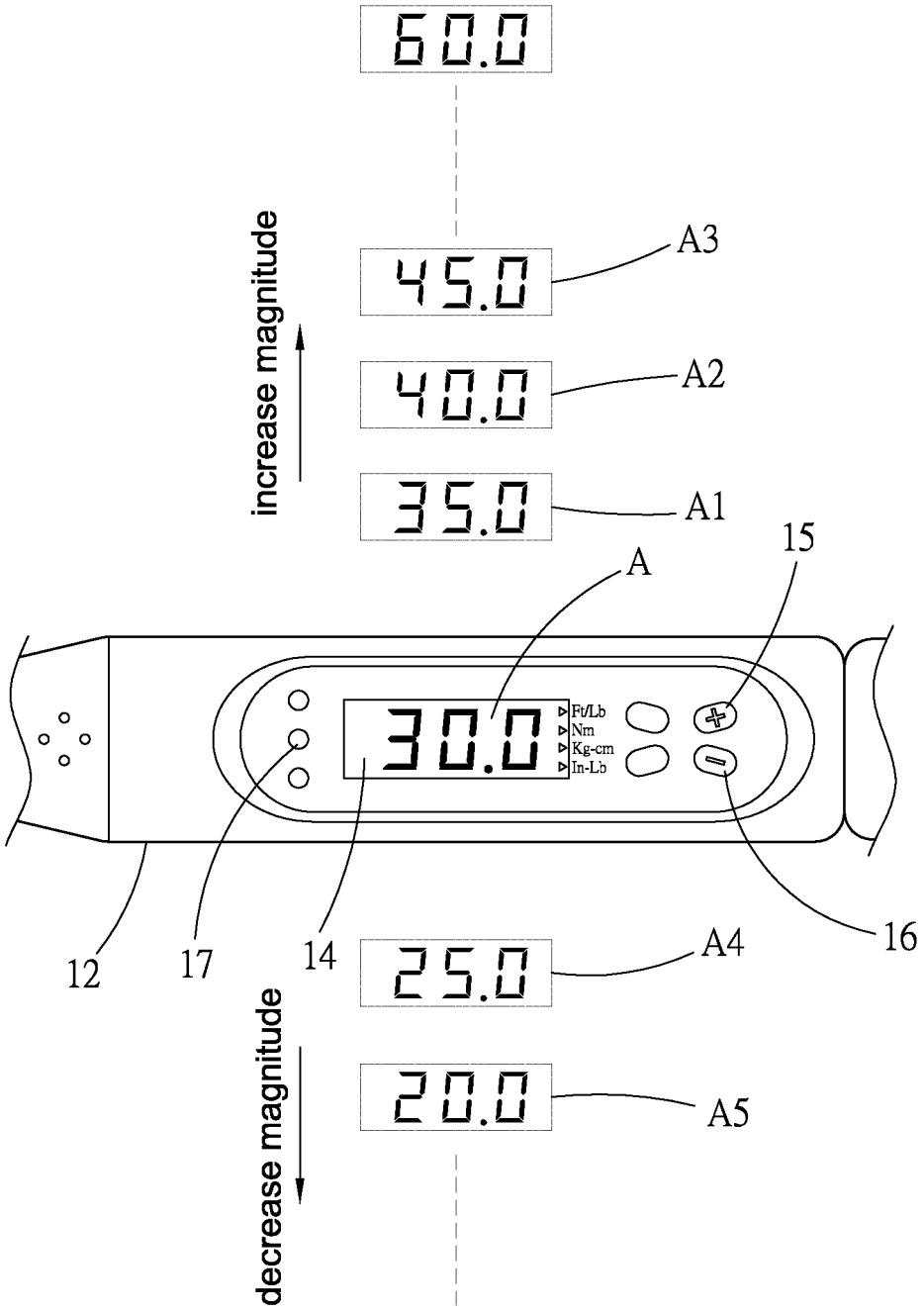
FIG. 2 shows the value setting intervals of the torque warning value of the first embodiment of the present invention.

In this embodiment, metric system is used and a torque range of the wrench 10 from 11 N/m to 60 N/m is taken as an example. Please refer to FIG. 2. In the case that the current torque warning value of the wrench is 30 N/m as indicated by A, in the warning value setting mode, when the increase pushbutton 15 is pressed, the torque warning value will skip to the next value, that is, 35 N/m A1. When continuously pressing the increase pushbutton 15, the warning value will become 40 N/m A2, 45 N/m A3, etc. Reversely, in the case that the current torque warning value of the wrench is 30 N/m, when the decrease pushbutton 16 is pressed, the torque warning value will be changed to 25 N/m A4. When continuously pressing the decrease pushbutton 16, the warning value will become 20 N/m A5, etc. It can be known from the set values A to A5 of FIG. 2 that in this embodiment, the torque warning values are discontinuous values with an interval of 5 metric system unit (increase magnitude and decrease magnitude) therebetween, rather than continuous values. The settable torque warning values are integers excluding any decimal. For example, the torque warning value can be only set 30.0, 35.0 or the like. It is impossible to set the torque warning value 30.1, 30.6 or the like value that includes a decimal.

The object of this design is to establish an operation mode for a user to make the torque warning value lower than the actually required torque value. With FIG. 3 taken as an example, when a work piece to be tightened requires a tightening force R of 38 N/m, a user can only set the torque warning value S of the wrench to be 35 N/m, which is the value that is approximate to, but not over the required tightening force R. It is impossible for the user to set the warning value S to be 38 N/m. Therefore, when the tightening force applied to the threaded member by the wrench reaches the warning value S of 35 N/m, the operation unit of the wrench will drive the warning lights or the buzzer to create warning effect emit (warning signal) for reminding the user that the tightening force is about to reach the required tightening force R of 38 N/m so as to urge the user to stop wrenching the threaded member. At this time, due to the wrenching inertia (from the brain's receiving the warning signal to the brain's ordering the hand to stop wrenching) of the operator, the operator will tighten the threaded member by a tightening force T of such as 37 N/m. Also, the warning signal will make the operator to watch the display unit 14 for realizing the magnitude (37 N/m) of the current actual tightening force, so that the operator can further tighten the threaded member to the required tightening force R of 38 N/m.

Figure 4:
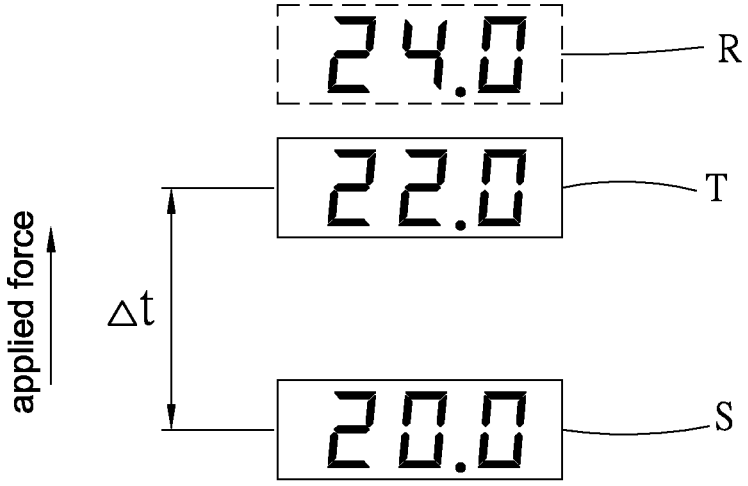
FIG. 4 shows another application of the first embodiment of the present invention.

FIG. 4 shows another application of the present invention. In the case that the required tightening force R of the next threaded member to be tightened is 24 N/m, in the torque setting mode, by means of pressing the decrease pushbutton 16, the torque warning value S can be set 20 N/m, which is not over the required tightening force R. When the tightening force applied to the threaded member by the wrench reaches the torque warning value S of 20 N/m, a warning signal is generated for reminding the user to stop wrenching the threaded member. At this time, due to the wrenching inertia, the operator will tighten the threaded member by an actual tightening force T of such as 22 or 23 N/m. Thereafter, the operator can carefully further tighten the threaded member to the required tightening force R of 24 N/m.

Due to the wrenching inertia, the actual tightening force T will exceed the warning value S by a torque increase value Δt. For example, in the case that the torque warning value S is 35 N/m, while the actual tightening force T under wrenching inertia is 37 N/m, then the torque increase value Δt due to the wrenching inertia is 2 N/m.

In the designed operation mode of the present invention, after many times of operation, an operator will become very skilled to make the torque increase value Δt due to the wrenching inertia a constant value such as 2 or 3 N/m (depending on the personal characters of different users).

Furthermore, the muscle memory caused by long-term exercise can precisely control the magnitude of the torque increase value Δt of such as 2~4 N/m. Therefore, in the case that the difference between the torque warning value S (such as 35 N/m) and the required tightening force R (such as 38 N/m) is 3 N/m, after the user feels the warning signal, the user can precisely control how great and how long the threaded member should be further wrenched to make the torque increase value Δt due to the wrenching inertia exactly 3 N/m. Accordingly, the threaded member can be accurately tightened by the required tightening force R even without watching the display unit 14 for confirmation.

In the present invention, the torque warning values S are discontinuous values with an interval therebetween so as to establish an operation mode in which the torque warning value S is lower than the required tightening force R. In the condition that the torque warning value S is lower than the required tightening force R, a user can freely select a warning value S. For example, as shown in FIG. 3, in the case that the required tightening force R is 38 N/m, the user can set the torque warning value S to be 30 N/m.

Figure 3:
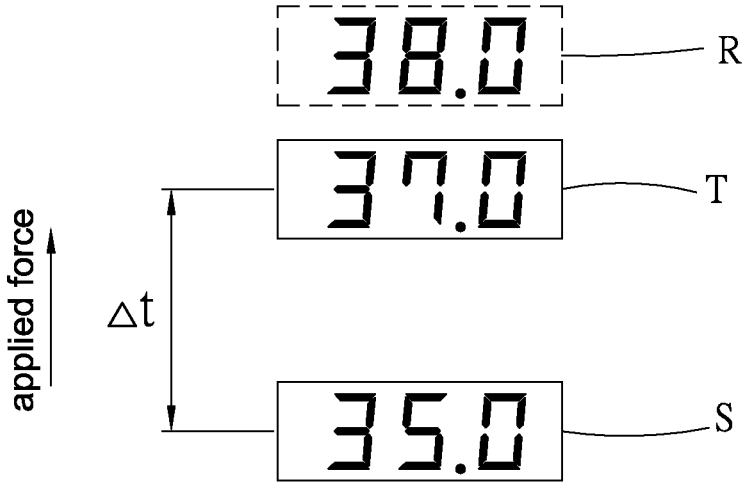
FIG. 3 shows an application of the first embodiment of the present invention.

Moreover, also as shown in FIG. 3, in the case that the required tightening force R is 40 N/m, although the user can set the torque warning value S to be 40 N/m, after the operation mode of the present invention is established by a user, the user will set the torque warning value S to be a value lower than 40 N/m, such as 35 N/m, rather than 40 N/m.

The interval between the torque warning values is not limited to that of the first embodiment. Alternatively, the interval can be any value larger than 2. For example, the interval between the torque warning values S can be 3, 6 or 10. In the case that the interval is 10, then the warning values S can be only multiples of 10. Similarly, in the case of 3, then the warning values S can be only multiples of 3.

Figure 5:
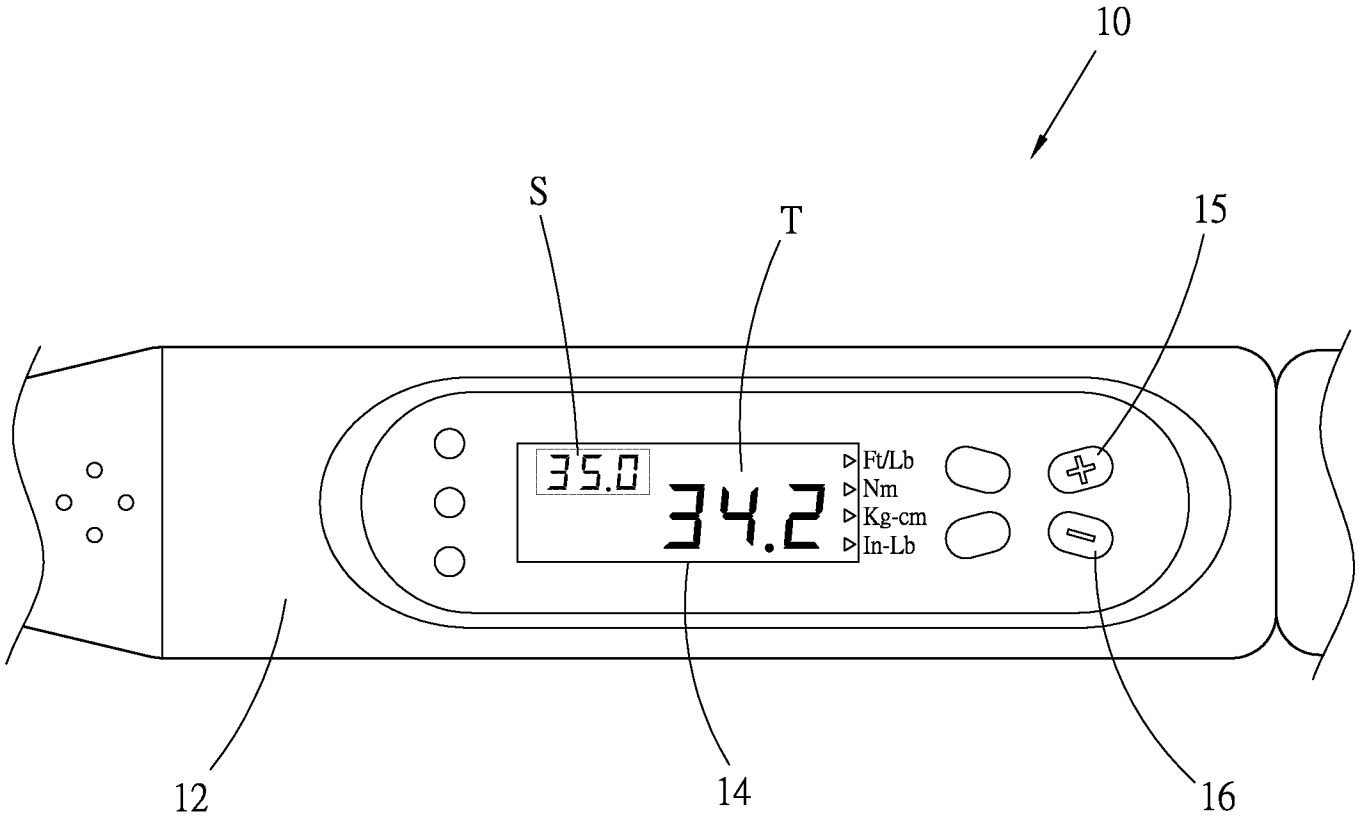
FIG. 5 is a top view of a part of a second embodiment of the present invention.

FIG. 5 shows a second embodiment of the present invention. When the torque tool is switched to the operation interface, the display unit 14 further has two numeral display positions. Not only the torque value in operation, that is, the actual tightening force T, is shown on the display unit 14, but also the torque warning value S is shown for a user to watch. The value of the actual tightening force T may include a decimal.

In the present invention, the torque warning values of the torque tool are discontinuous values with an interval therebetween so as to establish an operation mode in which "the torque warning value is lower than the required tightening force". In this case, it can be avoided that the actual tightening force exceeds the required tightening force due to wrenching inertia.

Moreover, before perceiving the warning signal, a user is no more necessary to worry about the possibility of over-tightening. Therefore, the operation can be more smoothly performed to shorten the operation time.

The above embodiments are only used to illustrate the present invention, not intended to limit the scope thereof. Many modifications of the above embodiments can be made without departing from the spirit of the present invention.

What is claimed is:

1. An electronic torque tool comprising:

a main body; a detection unit being disposed in the main body and capable of detecting a plurality of torque values for display, the detection unit detecting an actual torque value of the torque tool, the actual torque value being selected from the plurality of torque values;

a group of resettable torque warning values being selected from the plurality of torque values, each pair of adjacent resettable torque warning values of the group of said resettable torque warning values being spaced apart by an interval, the interval being an amount of torque, a number of values in the group of said resettable torque warning values is less than a number of values of the plurality of torque values, a torque warning value being selected from the group of said resettable torque warning values, a warning being emitted when the actual torque value and the torque warning value are equal;

at least one display unit disposed on the main body for displaying the plurality of torque values; and at least one pushbutton disposed on the main body for a user to set the torque warning value of the torque tool.

2. The electronic torque tool as claimed in claim 1, wherein the interval between the group of said resettable torque warning values is larger than 2.

3. The electronic torque tool as claimed in claim 2, wherein the display unit displays the torque warning value and the actual torque value of the torque tool in operation at the same time.

4. The electronic torque tool as claimed in claim 3, wherein the group of said resettable torque warning values are integers.

5. The electronic torque tool as claimed in claim 2, wherein the group of said resettable torque warning values are integers.

6. The electronic torque tool as claimed in claim 1, wherein the interval between the group of said resettable torque warning values is 5.

7. The electronic torque tool as claimed in claim 6, wherein the display unit displays the torque warning value and the actual torque value of the torque tool in operation at the same time.

8. The electronic torque tool as claimed in claim 7, wherein the group of said resettable torque warning values are integers.

9. The electronic torque tool as claimed in claim 6, wherein the group of said resettable torque warning values are integers.

10. The electronic torque tool as claimed in claim 1, wherein the interval between the group of said resettable torque warning values is 10.

11. The electronic torque tool as claimed in claim 10, wherein the display unit displays the torque warning value and the actual torque value of the torque tool in operation at the same time.

12. The electronic torque tool as claimed in claim 11, wherein the group of said resettable torque warning values are integers.

13. The electronic torque tool as claimed in claim 11, wherein the group of said resettable torque warning values and the interval are resettable and adjustable values.

14. The electronic torque tool as claimed in claim 10, wherein the group of said resettable torque warning values are integers.

15. The electronic torque tool as claimed in claim 1, wherein the interval between the group of said resettable torque warning values is 3.

16. The electronic torque tool as claimed in claim 1, wherein the interval between the group of said resettable torque warning values is 6.

17. The electronic torque tool as claimed in claim 1, wherein the display unit displays the torque warning value and the actual torque value of the torque tool in operation at the same time.

18. The electronic torque tool as claimed in claim 17, wherein the group of said resettable torque warning values are integers.

19. The electronic torque tool as claimed in claim 1, wherein the group of said resettable torque warning values are integers.

* * * * *